US011864589B2

(12) United States Patent
Liu

(10) Patent No.: US 11,864,589 B2
(45) Date of Patent: Jan. 9, 2024

(54) ATOMIZER

(71) Applicant: Shenzhen Eigate Technology Co., Ltd., Shenzhen (CN)

(72) Inventor: Tuanfang Liu, Shenzhen (CN)

(73) Assignee: Shenzhen Eigate Technology Co., Ltd., Shenzhen (CN)

( * ) Notice: Subject to any disclaimer, the term of this patent is extended or adjusted under 35 U.S.C. 154(b) by 441 days.

(21) Appl. No.: 17/232,112

(22) Filed: Apr. 15, 2021

(65) Prior Publication Data

US 2022/0132922 A1 May 5, 2022

(30) Foreign Application Priority Data

Oct. 30, 2020 (CN) ..... 202011188857.2
Oct. 30, 2020 (CN) ..... 202022457475.7

(51) Int. Cl.

| | |
|---|---|
| ***A24F 47/00*** | (2020.01) |
| ***A24F 40/40*** | (2020.01) |
| ***A24F 40/10*** | (2020.01) |
| ***A24F 40/42*** | (2020.01) |

(52) U.S. Cl.
CPC ..... *A24F 40/40* (2020.01); *A24F 40/10* (2020.01); *A24F 40/42* (2020.01)

(58) Field of Classification Search
CPC ..... A24F 40/10; A24F 40/42; A24F 40/46
See application file for complete search history.

(56) References Cited

U.S. PATENT DOCUMENTS

2015/0007836 A1* 1/2015 Li ..... A24F 40/46 131/329
2017/0006916 A1* 1/2017 Liu ..... H05B 3/03
2019/0350263 A1* 11/2019 Qiu ..... A24F 40/49
2020/0187567 A1* 6/2020 Liu ..... F16J 15/022

FOREIGN PATENT DOCUMENTS

WO WO-2016145613 A1 * 9/2016 ..... A24F 47/00

* cited by examiner

*Primary Examiner* — Eric Yaary
(74) *Attorney, Agent, or Firm* — MATTHIAS SCHOLL P.C.; Matthias Scholl

(57) ABSTRACT

An atomizer includes an elastic member. The elastic member includes an atomization core, a support base, an air regulation ring, and a seal ring. The support base includes an e-liquid inlet. The atomization core is disposed on the support base to atomize e-liquid. The seal ring is disposed in the support base and below the atomization core. The air regulation ring is disposed around the support base; when the air regulation ring is pulled down, the atomization core is ejected from the top of the atomizer for replacement, and the e-liquid inlet of the support base is automatically sealed by the seal ring so that no e-liquid leaks out of the atomizer.

8 Claims, 5 Drawing Sheets

ATOMIZER

CROSS-REFERENCE TO RELATED APPLICATIONS

Pursuant to 35 U.S.C. § 119 and the Paris Convention Treaty, this application claims foreign priority to Chinese Patent Application No. 202011188857.2 filed on Oct. 30, 2020, and to Chinese Patent Application No. Chinese Patent Application No. Chinese Patent Application No. 202022457475.7 filed on Oct. 30, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an atomizer.

Conventionally, the atomization core is in threaded connection to the bottom end of the atomizer. When the atomization core needs to be replaced, it is screwed out from the bottom end of the atomizer. In the process, the e-liquid tends to spill and contaminate the atomizer.

SUMMARY

The disclosure provides an atomizer, comprising an elastic member; the elastic member comprises an atomization core, a support base, an air regulation ring, and a seal ring; the support base comprises an e-liquid inlet; the atomization core is disposed on the support base to atomize e-liquid; the seal ring is disposed in the support base and below the atomization core; the air regulation ring is disposed around the support base; when the air regulation ring is pulled down, the atomization core is ejected from a top of the atomizer for replacement, and the e-liquid inlet of the support base is automatically sealed by the seal ring so that no e-liquid leaks out of the atomizer.

In a class of this embodiment, the elastic member further comprises a first spring; the first spring is disposed in a bottom of the seal ring and is configured to press down the seal ring; under the resilience force of the first spring, the seal ring is reset.

In a class of this embodiment, the air regulation ring comprises an orbital groove; and the seal ring comprises a groove.

In a class of this embodiment, the elastic member further comprises a marble and a first rubber ring; the marble is disposed in a hole of the support base; the first rubber ring is disposed on an inner wall of the air regulation ring and below the orbital groove to squeeze the marble to move towards an inner side of the hole.

In a class of this embodiment, the support base comprises a plurality of holes.

In a class of this embodiment, the plurality of holes, a plurality of marbles, and the first rubber ring are located on a horizontal plane; when the atomization core is disposed in the support base, the seal ring moves downwards along with the atomization core, and the first spring deforms to produce an upward elastic force; when the groove and the plurality of holes are in one plane, the plurality of marbles is squeezed into the groove and limits the seal ring.

In a class of this embodiment, the elastic member further comprises a second spring; the second spring is disposed on a bottom of the air regulation ring to pull the air regulation ring; and under a resilience force of the second spring, the air regulation ring is reset.

In a class of this embodiment, the elastic member further comprises a base disposed on a bottom of the support base to support the first spring and the second spring.

In a class of this embodiment, upon replacing the atomization core, the air regulation ring is pulled down, and the first rubber ring moves downwards so that the plurality of marbles is free of the squeezing of the first rubber ring; under an upward elastic force of the first spring, the plurality of marbles moves from the groove of the seal ring to outer sides of the plurality of holes and stays in the orbital groove of the air regulation ring; the seal ring bounces and seals the e-liquid inlet of the support base; the atomization core pops up from a top opening of the support base and is taken out from a top opening of the fixed base; and when the air regulation ring is withdrawn, components reset.

In a class of this embodiment, the atomizer further comprises an electrode, an insulation ring, a second rubber ring, and a joint; the insulation ring and the second rubber ring are disposed in a bottom opening of the base; the joint is disposed through the insulation ring and the second rubber ring; and the electrode is disposed on the joint and connected to the atomization core for electric conduction.

In a class of this embodiment, the atomizer further comprises an e-liquid storage module, wherein the e-liquid storage module comprises a mouthpiece, a rotary cover, a first seal ring sealing the mouthpiece, a second seal ring sealing the rotary cover, a fixed base fixing the rotary cover, an upper seal ring, a glass tube, an atomization core, a lower seal ring; the first seal ring is disposed in the rotary cover to seal the mouthpiece; the mouthpiece is disposed in the rotary cover; the second seal ring is disposed in an upper part of the fixed base to seal the rotary cover; the rotary cover is disposed on the top of the fixed base; the upper seal ring is disposed in a bottom of the fixed base to seal an upper end of the glass tube; the upper end of the glass tube abuts against the bottom of the fixed base; and the lower seal ring is disposed around a lower end of the glass tube.

In a class of this embodiment, the elastic member is disposed on the lower end of the glass tube; the support base is in threaded connection to the fixed base; and when the rotary cover is removed, the atomization core is replaceable.

DETAILED DESCRIPTION

To further illustrate, embodiments detailing an atomizer are described below. It should be noted that the following embodiments are intended to describe and not to limit the disclosure.

Figure 1:
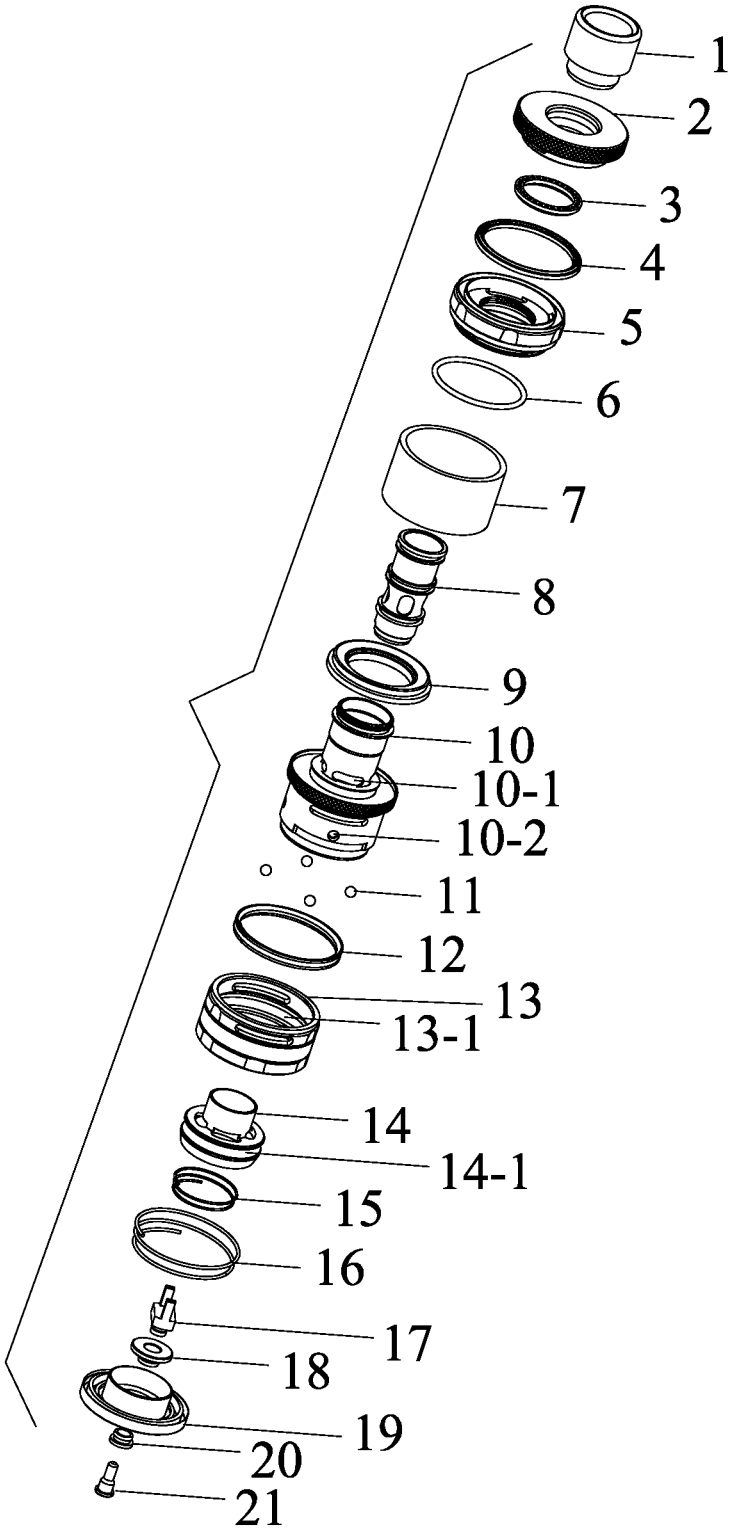
FIG. 1 is an exploded view of an atomizer in accordance with one embodiment of the disclosure.
Figure 2:
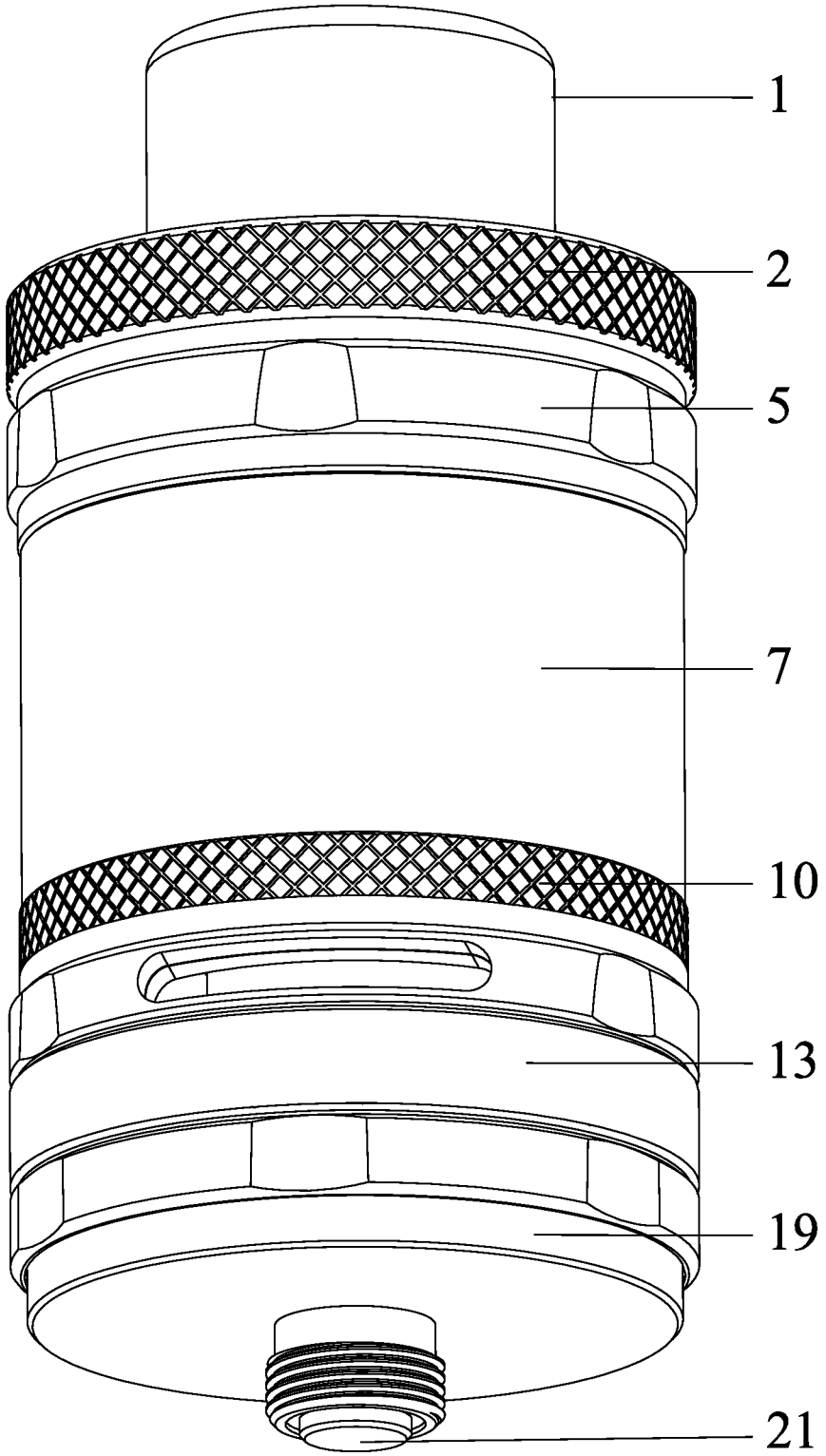
FIG. 2 is a schematic diagram of an atomizer in accordance with one embodiment of the disclosure.
Figure 3:
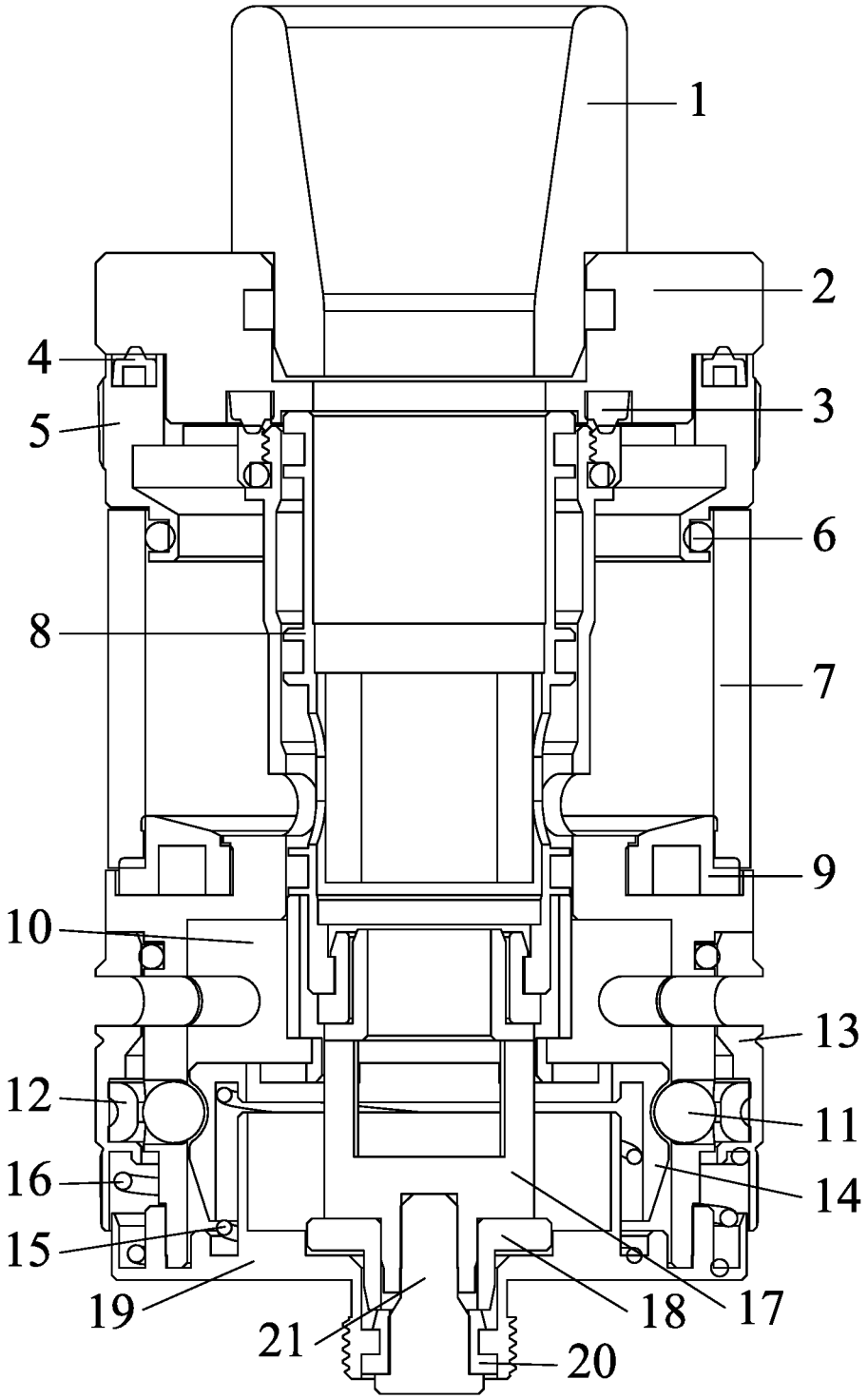
FIG. 3 is a sectional view of an atomizer in accordance with one embodiment of the disclosure.
Figure 4:
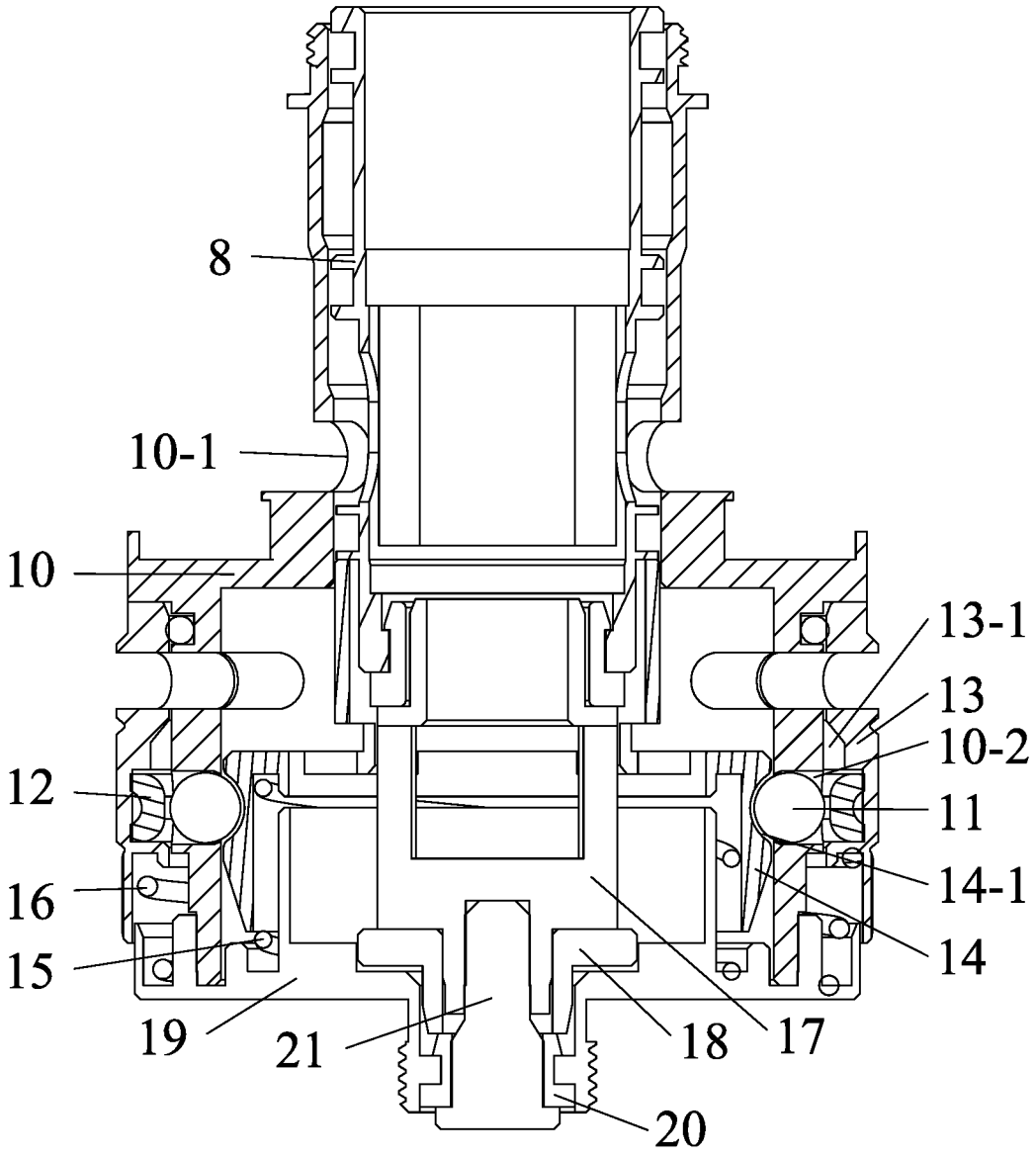
FIG. 4 is a sectional view of an elastic member of an atomizer in accordance with one embodiment of the disclosure.
Figure 5:
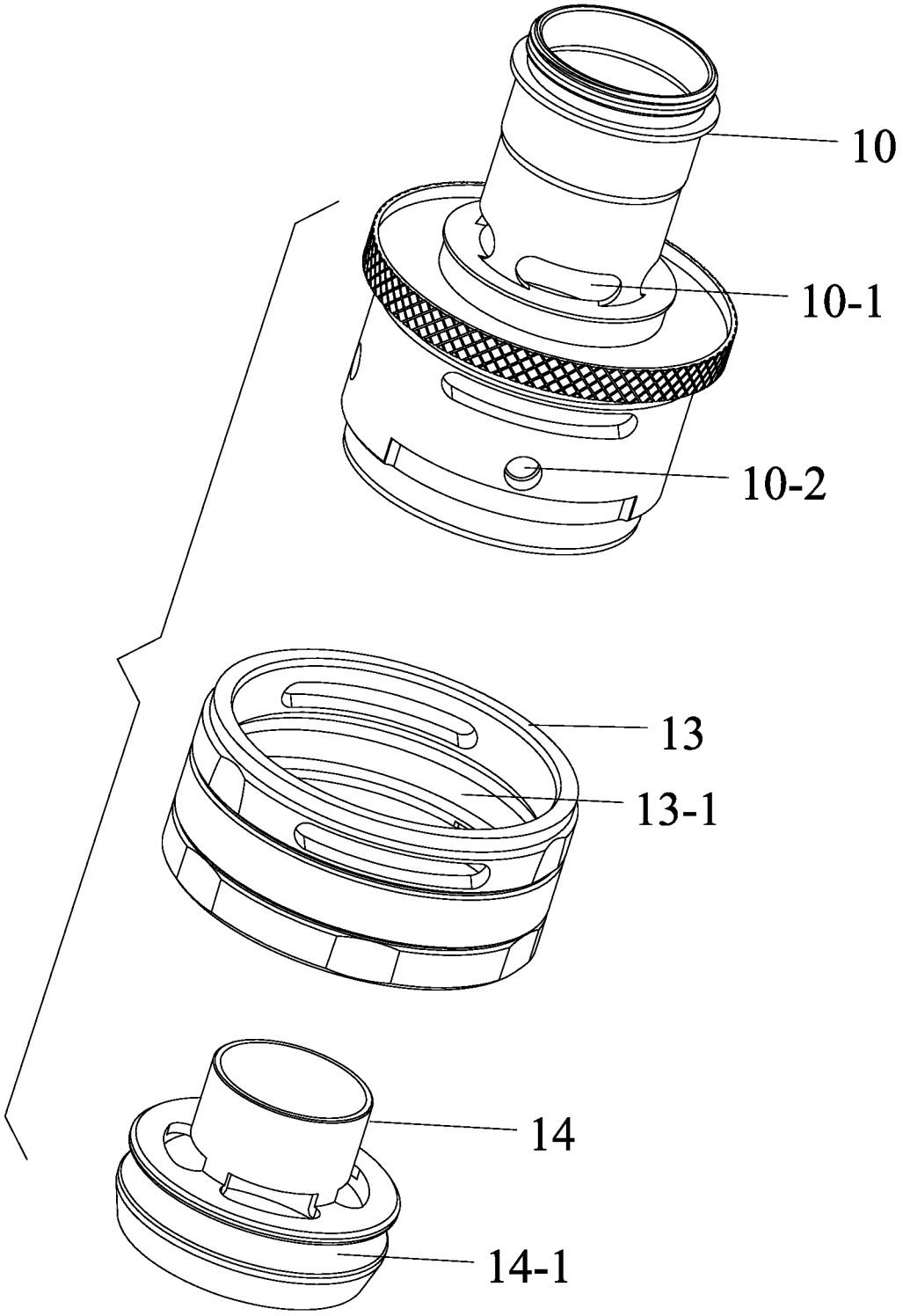
FIG. 5 is an exploded view of an air passage of an atomizer in accordance with one embodiment of the disclosure.

As shown in FIGS. 1-5, the disclosure provides a mouthpiece 1, a rotary cover 2, a first seal ring 3 sealing the mouthpiece, a second seal ring 4 sealing the rotary cover, a fixed base 5 fixing the rotary cover, an upper seal ring 6, a glass tube 7, an atomization core 8, a lower seal ring 9, a support base 10, a plurality of marbles 11, a first rubber ring 12, an air regulation ring 13, a third seal ring 14, a first spring 15, a second spring 16, an electrode 17, an insulation ring 18, a base 19, a second rubber ring 20, and a joint 21. The support base 10 comprises an e-liquid inlet 10-1 and a plurality of holes 10-2 for receiving the plurality of marbles 11. The air regulation ring 13 comprises an orbital groove 13-1. The first seal ring 3 is disposed in the rotary cover 2 to seal the mouthpiece 1. The mouthpiece 1 is disposed in the rotary cover 2. The second seal ring 4 is disposed in the upper part of the fixed base 5 to seal the rotary cover 2. The rotary cover 2 is disposed on the top of the fixed base 5. The upper seal ring 6 is disposed in the bottom of the fixed base 5 to seal the upper end of the glass tube 7. The upper end of the glass tube 7 abuts against the bottom of the fixed base 5. The lower seal ring 9 is disposed around the lower end of the glass tube 7. The rotary cover 2 is detachably connected to the fixed base 5 so that e-liquid is injected into the glass tube 7 via the e-liquid injection hole of the fixed base 5. The atomization core 8 is disposed on the support base 10 to atomize the e-liquid. The third seal ring 14 is disposed in the support base 10 and below the atomization core 8. The first spring 15 is disposed in the bottom of the third seal ring 14 and is configured to press down the third seal ring 14. Under the resilience force of the first spring 15, the third seal ring 14 is reset to seal the e-liquid inlet 10-1 of the support base 10. The plurality of marbles 11 is disposed in the plurality of holes 10-2 of the support base 10. The first rubber ring 12 is disposed on the inner wall of the air regulation ring 13 and below the orbital groove 13-1 to squeeze the plurality of marbles 11 to move towards the inner sides of the plurality of holes 10-2. The air regulation ring 13 is disposed around the support base 10. The second spring 16 is disposed on the bottom of the air regulation ring 13 to pull the air regulation ring 13. Under the resilience force of the second spring 16, the air regulation ring 13 is reset. The base 19 is disposed on the bottom of the support base 10 to support the first spring 15 and the second spring 16. The plurality of holes 10-2, the plurality of marbles 11, and the first rubber ring 12 are located on the same horizontal plane. The third seal ring 14 comprises a groove 14-1. When the atomization core 8 is disposed in the support base 10, the third seal ring 14 moves downwards along with the atomization core 8, and the first spring 15 deforms to produce an upward elastic force. When the groove 14-1 and the plurality of holes 10-2 are in one plane, the plurality of marbles 11 is squeezed into the groove 14-1 and limits the third seal ring 14. The insulation ring 18 and the second rubber ring 20 are disposed in the bottom opening of the base 19. The joint 21 is disposed through the insulation ring 18 and the second rubber ring 20. The electrode 17 is disposed on the joint 21 and connected to the atomization core 8 for electric conduction. The support base 10 is disposed on the bottom end of the glass tube 7 and is in threaded connection to the fixed base 5. When the rotary cover 2 is removed, the atomization core 8 can be replaced. When replacing the atomization core 8, the air regulation ring 13 is pulled down, and the first rubber ring 12 moves downwards so that the plurality of marbles 11 is free of the squeezing of the first rubber ring 12. Under the upward elastic force of the first spring 15, the plurality of marbles 11 moves from the groove 14-1 of the third seal ring 14 to outer sides of the plurality of holes 10-2 and stays in the orbital groove 13-1 of the air regulation ring 13. The third seal ring 14 bounces and seals the e-liquid inlet 10-1 of the support base 10. The atomization core 8 pops up from the top opening of the support base 10 and can be taken out from the top opening of the fixed base 5. When the air regulation ring 13 is withdrawn, the components reset.

The following advantages are associated with the atomizer of the disclosure:

1. The atomizer comprises an elastic member for replacement of an atomization core and sealing an e-liquid inlet; when the air regulation ring is pulled down, the atomization core is ejected from the top of the atomizer for replacement, and the e-liquid inlet of the support base is automatically sealed by the seal ring so that no e-liquid leaks out of the atomizer.

2. The atomization core of the atomizer can be taken out and replaced from the top of the atomizer. The atomization core of conventional atomizers can only be replaced from the bottom end of the atomizers.

3. The elastic member of the atomizer is novel.

It will be obvious to those skilled in the art that changes and modifications may be made, and therefore, the aim in the appended claims is to cover all such changes and modifications.

What is claimed is:

1. An atomizer, comprising an elastic member, wherein the elastic member comprises an atomization core, a support base, an air regulation ring, and a seal ring; the support base comprises an e-liquid inlet; the atomization core is disposed on the support base to atomize e-liquid; the seal ring is disposed in the support base and below the atomization core; the air regulation ring is disposed around the support base;

characterized in that:

the elastic member further comprises a first spring, a marble and a first rubber ring;

the first spring is disposed in a bottom of the seal ring and is configured to push the seal ring upwards, and under the resilience force of the first spring, the seal ring is reset;

the air regulation ring comprises an orbital groove;

the seal ring comprises a groove;

the marble is disposed in a hole of the support base;

the first rubber ring is disposed on an inner wall of the air regulation ring and below the orbital groove to squeeze the marble to move towards an inner side of the hole;

the hole, the marble, and the first rubber ring are located on a horizontal plane;

when the atomization core is disposed in the support base, the seal ring moves downwards along with the atomization core, and the first spring deforms to produce an upward elastic force; when the groove and the hole are in one plane, the marble is squeezed into the groove and limits the seal ring; and when the air regulation ring is pulled down, the atomization core is ejected from a top of the atomizer for replacement, and the e-liquid inlet of the support base is automatically sealed by the seal ring so that no e-liquid leaks out of the atomizer.

2. The atomizer of claim 1, wherein the support base comprises a plurality of holes, and the elastic member comprises a plurality of marbles.

3. The atomizer of claim 1, wherein the elastic member further comprises a second spring; the second spring is disposed on a bottom of the air regulation ring to push the air regulation ring; and under a resilience force of the second spring, the air regulation ring is reset.

4. The atomizer of claim 3, wherein the elastic member further comprises a base disposed on a bottom of the support base to support the first spring and the second spring.

5. The atomizer of claim 2, wherein upon replacing the atomization core, the air regulation ring is pulled down, and the first rubber ring moves downwards so that the plurality of marbles is free of the squeezing of the first rubber ring; under an upward elastic force of the first spring, the plurality of marbles moves from the groove of the seal ring to outer sides of the plurality of holes and stays in the orbital groove of the air regulation ring; the seal ring bounces and seals the e-liquid inlet of the support base; the atomization core pops up from a top opening of the support base; and when the air regulation ring is withdrawn, components reset.

6. The atomizer of claim 1, further comprising an electrode, an insulation ring, a second rubber ring, and a joint, wherein the insulation ring and the second rubber ring are disposed in a bottom opening of the base; the joint is disposed through the insulation ring and the second rubber ring; and the electrode is disposed on the joint and connected to the atomization core for electric conduction.

7. The atomizer of claim 3, further comprising an e-liquid storage module, wherein the e-liquid storage module comprises a mouthpiece, a rotary cover, a first seal ring sealing the mouthpiece, a second seal ring sealing the rotary cover, a fixed base fixing the rotary cover, an upper seal ring, a glass tube, a lower seal ring; the first seal ring is disposed in the rotary cover to seal the mouthpiece; the mouthpiece is disposed in the rotary cover; the second seal ring is disposed in an upper part of the fixed base to seal the rotary cover; the rotary cover is disposed on a top of the fixed base; the upper seal ring is disposed in a bottom of the fixed base to seal an upper end of the glass tube; the upper end of the glass tube abuts against the bottom of the fixed base; and the lower seal ring is disposed around a lower end of the glass tube.

8. The atomizer of claim 3, wherein the elastic member is disposed on the lower end of the glass tube; the support base is in threaded connection to the fixed base; and when the rotary cover is removed, the atomization core is replaceable.

* * * * *